US005778961A

United States Patent [19]

Hugo et al.

[11] Patent Number: 5,778,961

[45] Date of Patent: Jul. 14, 1998

[54] PROCESS AND DEVICE FOR SIMULTANEOUS CASTING AND DIRECTIONAL SOLIDIFICATION OF SEVERAL CASTINGS

[75] Inventors: Franz Hugo, Aschaffenburg; Ulrich Betz, Hasselroth, both of Germany

[73] Assignee: ALD Vacuum Technologies GmbH, Erlensee, Germany

[21] Appl. No.: 787,088

[22] Filed: Jan. 22, 1997

[30] Foreign Application Priority Data

Jan. 25, 1996 [DE] Germany ..... 196 02 554.0

[51] Int. Cl.[6] ..... B22D 27/04

[52] U.S. Cl. ..... 164/122.1; 164/338.1

[58] Field of Search ..... 164/122.1, 122.2, 164/338.1

[56] References Cited

U.S. PATENT DOCUMENTS

| | | | |
|---|---|---|---|
| 3,845,808 | 11/1974 | Higginbotham . | |
| 4,773,467 | 9/1988 | Graham et al. . | |
| 5,275,227 | 1/1994 | Staub . | |
| 5,568,833 | 10/1996 | Frasier | 164/122.1 |

FOREIGN PATENT DOCUMENTS

| | | | |
|---|---|---|---|
| 1202466 | 4/1986 | Canada | 164/122.2 |
| 0278762 | 8/1988 | European Pat. Off. . | |
| 0603738 | 6/1994 | European Pat. Off. . | |
| 2657551 | 4/1978 | Germany . | |
| 2815818 | 10/1978 | Germany . | |
| 4415855 | 5/1995 | Germany . | |
| 1343459 | 1/1974 | United Kingdom . | |
| 2033270 | 5/1980 | United Kingdom . | |
| 2106021 | 4/1983 | United Kingdom | 164/122.1 |

OTHER PUBLICATIONS

Investment Casting Institute, Proceedings—42nd Annual Technical Meeting Sep. 25–28, 1994; Directional And Single Crystal Solidification Using Liquid Metal Cooling, F. Hugo, H. Mayer, R.F. Singer, Paper No. 9.

Investment Casting Institute: 42nd Annual Technical Meeting 1994 "Directional And Single Crystal Solidification Using Liquid Metal Cooling"; F. Hugo, H. Mayer, R.F. Singer, pp. 9:1 to 9:12.

*Primary Examiner*—Kuang Y. Lin

*Attorney, Agent, or Firm*—Felfe & Lynch

[57] ABSTRACT

During the simultaneous casting and directional solidification of several castings in pre-heated casting moulds (11), these standing around a central cavity (H) on a ring-shaped cooling plate (5) after pouring off are continuously removed from a heating chamber (14) by a vertical movement relative to the heating chamber in accordance with the solidification temperature and the castings are cooled by heat radiation to below the solidus temperature. In order to increase the production rate and the product quality, the casting moulds (11) are moved over a firm heat sink (9) during the directional solidification by continuous relative movement of the cooling plate (5), said heat sink thereby penetrating into the cavity (H).

14 Claims, 4 Drawing Sheets

PROCESS AND DEVICE FOR SIMULTANEOUS CASTING AND DIRECTIONAL SOLIDIFICATION OF SEVERAL CASTINGS

BACKGROUND OF THE INVENTION

The invention relates to a process for simultaneous casting and directional solidification of several castings in preheated casting moulds in each case with at least one mould cavity, wherein the casting moulds standing around a central cavity on a ring-shaped cooling plate after pouring off are continuously removed from a heating chamber by a vertical movement relative to the heating chamber in accordance with the solidification temperature and the castings are cooled by heat radiation to below the solidus temperature.

The paper by Hugo/Mayer/Singer: "Directional and Single Crystal Solidification using Liquid Metal Cooling", published in "Proceedings of the 42nd Annual Technical Meeting 1994" (25 to 28 September 1994, Ritz-Carlton Hotel in Buckhead, Atlanta, Ga., USA), two discloses fundamentally different processes for the directional solidification of castings, i.e.:

a) a process similar to the initially specified process with radiation cooling, but with a disc-shaped closed cooling plate, and b) a process for cooling by immersion of the casting moulds into a cooling bath and heat conduction.

A clear distinction will be made between these two processes.

A device with a vacuum chamber in which a process can be carried out with radiation cooling in accordance with a) is described in DE 44 15 855 C1. By forming a steep vertical temperature gradient a solid/liquid interphase is formed in the castings which, in accordance with the rate of movement of the castings in relation to the bottom edge of the heating chamber, shifts from the bottom upwards through the castings and causes a directional and/or single-crystal solidification of the castings.

However, the disadvantage herein is that the ring-shaped casting moulds placed on the edge of a circular disc-shaped cooling plate can predominantly only radiate their thermal energy outwards and onto the wall of the vacuum chamber. The energy radiated inwards at least partially hits the other casting moulds and heats these up or is even reflected many times by the individual casting moulds in the cavity between the casting moulds. The consequences are that in addition to the vertical temperature gradients, relatively steep horizontal or radial temperature gradients are formed in each casting which unfavourably affect the course of the interphases. This alone will restrict the rate of solidification.

Moreover, the heating elements present in the heating chamber radiate their energy into the cavity between the casting moulds through the spaces between the casting moulds or the casting channels, so that cooling is impaired by radiation out of the already solidified region of the castings. As a result, the production rate is greatly impaired overall, i.e. in particular in the production of large castings such as long turbine blades with correspondingly large cross-sections, for example.

Comparable, i.e. one-sided solidification conditions also occur in the processes and devices according to U.S. Pat. No. 4 773 467 and DE 26 57 551 B2, in which the cooling plates are of closed or disc-shaped construction. Although the cooling plate according to DE 26 57 551 B2 is itself ring-shaped, the central hole through the upper end of a fixedly inserted support rod serving to lower the casting moulds is closed off. It is specifically stated that no heat transfer should occur through the support rod. The invention in accordance with the generic notion is based on DE 26 57 551 B2.

Through DE 28 15 818 A1 based on a different generic notion and the already mentioned paper by Hugo/Mayer/Singer, it is also known to immerse a disc-shaped quenching plate with several casting moulds into a cooling bath composed of molten metal (tin, aluminium) in order to increase the steepness of the temperature gradients in accordance with b), and to transfer the heat from the casting moulds by heat conduction. However, it is stated in DE 28 15 818 A1 that it is necessary to allow an insulating plate to float on the cooling bath in order to prevent the evaporation of the tin in the necessary vacuum. Moreover, because of the supply of heat from the moulds, the tank for the cooling bath must be cooled itself at the upper end and heated at the lower end to be able to maintain a given temperature. If necessary, the uniformity of temperature must be forced by a stirring device. For a large number of casting moulds such a process and such a device are either not suitable or they require expensive installations. In particular, the expenditure involved in control systems is considerable.

Therefore, the object of the invention is to increase the steepness of the vertical temperature gradient without an immersion bath and as a result increase the production rate by directionally and/or single-crystal solidified castings, and in this case reduce the steepness of the radial or horizontal temperature gradients.

SUMMARY OF THE INVENTION

The stated object is achieved in the aforementioned process according to the invention in that the casting moulds are moved over a heat sink during the directional solidification by a continuous relative movement of the cooling plate.

The stated object is achieved in its full scope by this, i.e. the steepness of the vertical temperature gradient is increased and as a result the production rate is increased by directionally and/or single-crystal solidified castings, and in this case the steepness of the radial or horizontal temperature gradients reduced.

The term "ring-shaped" in association with the outer cooling plate does not necessarily mean "circular ring-shaped", but covers all rotationally symmetric, frame-like geometrical shapes such as for example rectangular, square and other polygonal shapes, accordingly, the outer cooling plate may also be composed from ring sectors which are arranged in rows on the periphery with relatively small interstices.

The heat sink allows radiation not only from the outer mould walls, but also from the inner mould walls, and as a result increases the entire thermal radiation output and improves the curve of the vertical temperature gradient. Moreover, more uniform temperature gradients are also achieved in horizontal direction through the more uniform radiation of thermal energy from all surfaces, i.e. over the cross-section of the castings or turbine blades.

As a result of the achievable, steeper vertical temperature gradients, the economy of the production process and the product quality are increased. This includes improvement in the microstructure, e.g. smaller dendrite gaps, lesser tendency towards defective grain formation, reduced segregation in the case of alloys and lower porosity of the castings.

It is particularly advantageous herein if a ring-shaped radiation baffle and a disc-shaped radiation baffle arranged at least substantially concentrically in this are arranged at the exit end of the heating chamber, and if the casting moulds arranged in a ring shape are continuously moved through the annular gap formed between the two radiation baffles in the active region of the heat sink.

As a result of this, the possibility of radiation energy falling from the heating chamber into the cavity between the casting moulds is virtually completely excluded.

The invention also relates to a device for simultaneous casting and directional solidification of several castings in casting moulds in each case with at least one mould cavity, with a heating chamber and a ring-shaped cooling plate for erecting the casting moulds in the heating chamber around a central cavity, wherein the casting moulds after the pouring off may be continuously removed from the heating chamber by a vertical movement relative to the heating chamber in accordance with the solidification temperature and the castings may be cooled by heat radiation to below the solidus temperature.

To achieve the above stated object, such a device is characterised according to the invention in that a heat sink is provided, into the active region of which the casting moulds may be moved during the directional solidification by continuous relative movement in relation to the heat sink penetrating into the cavity.

It is particularly advantageous here if a ring-shaped radiation baffle and a disc-shaped radiation baffle arranged at least substantially concentrically in this embodiment are arranged at the exit end of the heating chamber, and if the casting moulds arranged in a ring shape are continuously moved through the annular gap formed between the two radiation baffles in the active region of the heat sink.

In accordance with a further configuration of the subject of the invention, it is particularly advantageous if the axial distance between the heating chamber and the heat sink is constant during the solidification process.

A particularly compact and simply controlled production plant is characterised according to the further invention in that the ring-shaped cooling plate is arranged with the casting moulds on a transport carriage, which has an opening, through which the heat sink may be raised from a position below the transport carriage into a position above the transport carriage.

It is additionally advantageous if the heat sink is constructed as a cooling body, the axial length of which corresponds at least to the height dimensions of the casting moulds.

The exterior of the cooling body may in this case have a wide variety of geometric shapes, whereby the simplest shape is that of a cylinder. However it is expedient in order to improve the heat transfer to provide the cooling body with axis parallel and/or radial ribs which can be formed by a plate stack which surrounds a hollow member with liquid coolant flowing through it. In this case, radial ribs may be provided with an undulating structure on the periphery to prevent the thermal radiation from having a "glimpse" through interstices. However, the basic contour of the cooling bodies may also be constructed in a star, prismatic, polygonal shape etc. In any case, the cooling body should take up as large a portion of the cavity between all the casting moulds as possible in order to reduce the visible connection between the individual casting moulds as far as at all possible. It is essential in this case for the cooling body to have a solid structure.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
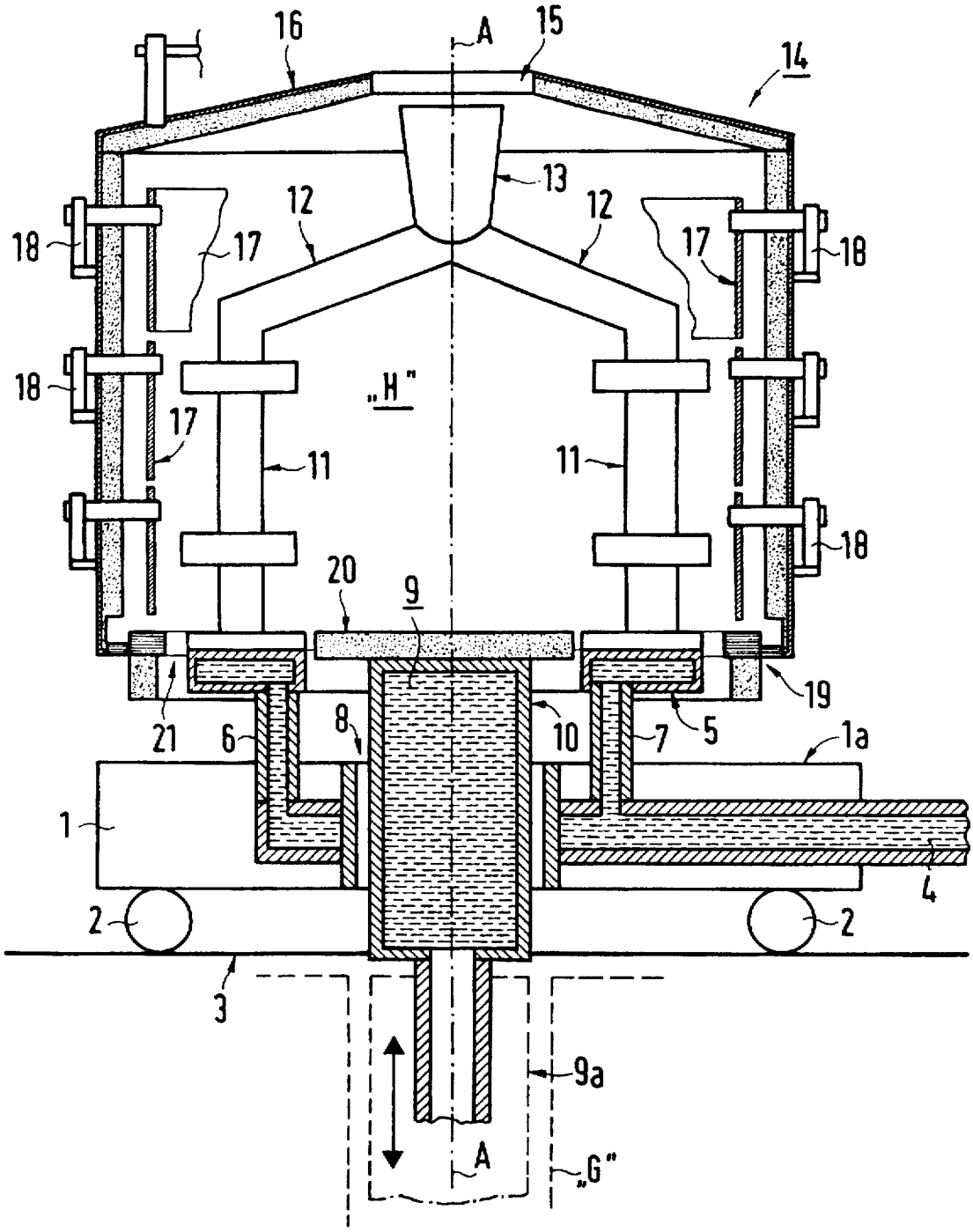
FIG. 1 shows a vertical section through the device with the casting moulds in the heating and casting position.
Figure 2:
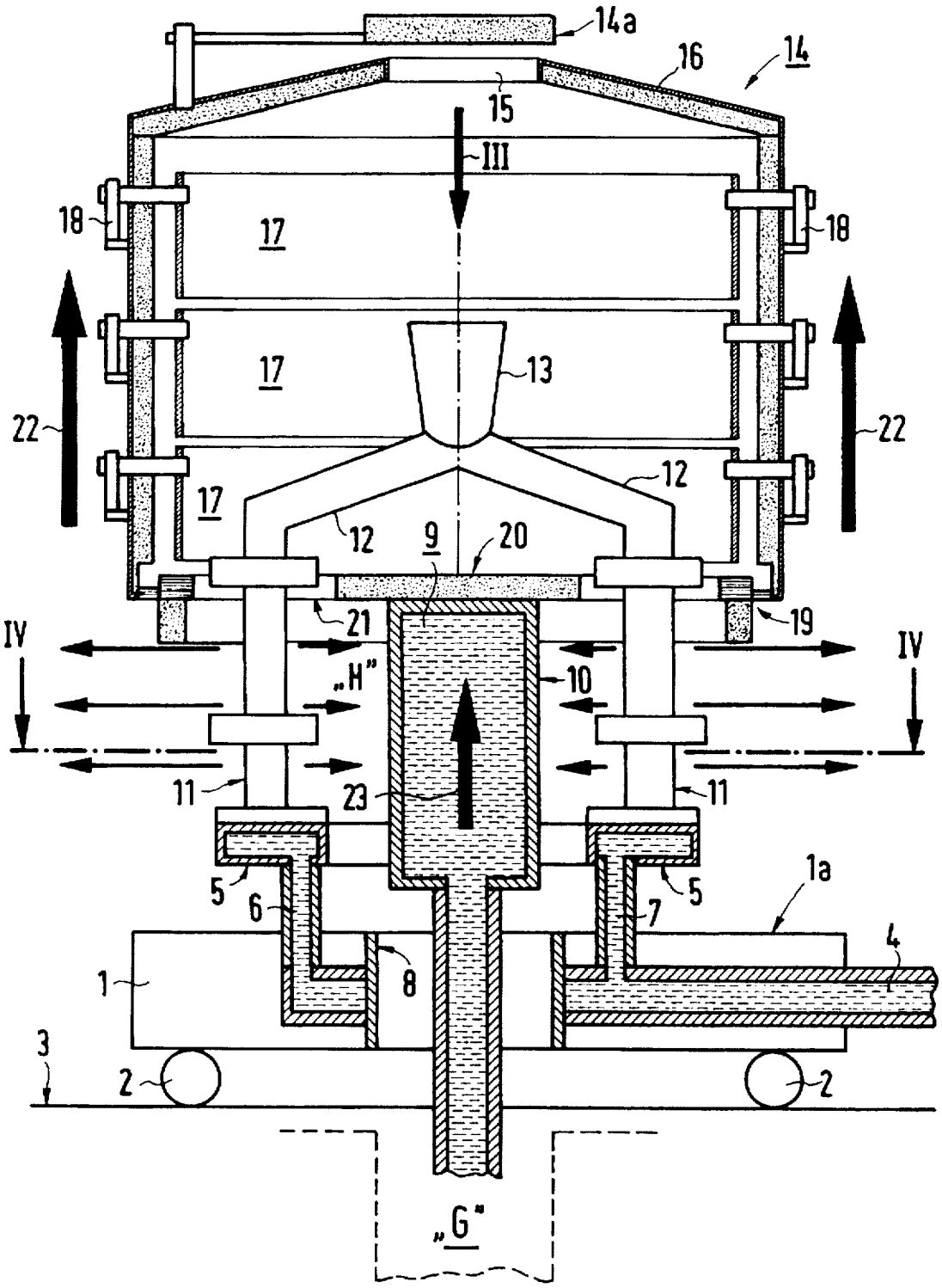
FIG. 2 shows the device according to FIG. 1 shortly before the end of the directional solidification.

A transport carriage 1 is shown in FIGS. 1 and 2 which may be moved horizontally by means of wheels 2 on rails 3. The transport carriage 1 bears a ring-shaped cooling plate 5 which is connected to the cooling circuit 4 via pipes 6 and 7. An opening 8 is arranged coaxially to the cooling plate 5 in the transport carriage 1 to allow the vertical passage of a heat sink 9 which is constructed as a water-cooled hollow body with a cylindrical outer surface 10. The heat sink 9 is mounted to be fixed, but is vertically displaceable along the axis A—A and may be lowered so far into a pit G (shown in broken lines) into a position 9*a* that the transport carriage 1 can be moved for the mould change. The axis A—A also determines the position of the opening 8 during pre-heating, casting and solidification.

Figure 3:
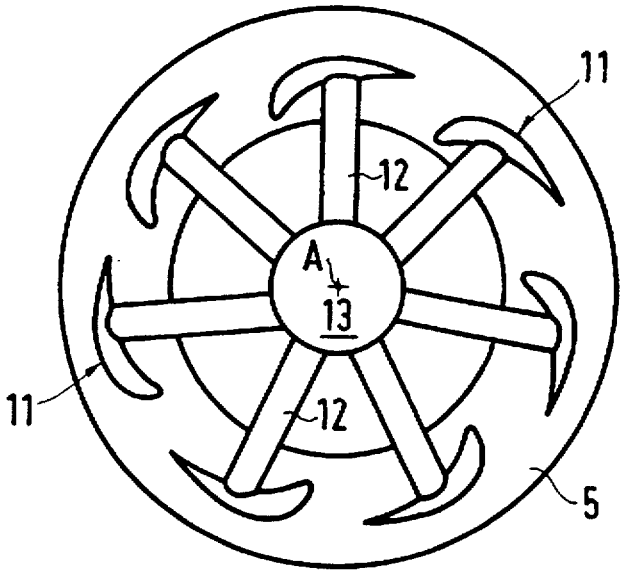
FIG. 3 is a vertical top view onto the casting moulds in the direction of the arrow III in FIG. 2.
Figure 4:
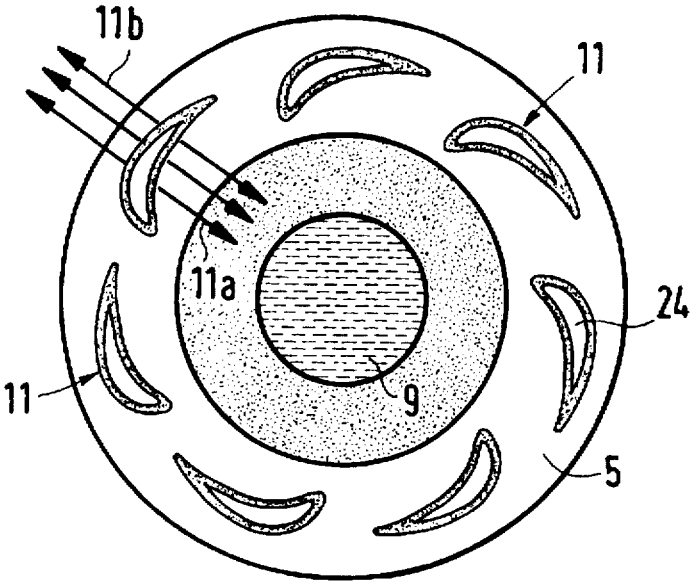
FIG. 4 shows a horizontal section through the subject of FIG. 2, taken along line IV—IV but without the transport carriage.

A group of dead moulds 11 made of ceramic materials, which are connected to the pouring basin 13 via casting channels 12, are arranged on the cooling plate 5 standing around a central cavity H in a concentric arrangement to the axis A—A (FIGS. 3 and 4). For reasons of clarity, only two diametrically opposed casting moulds are shown, the others are not shown.

For heating to temperatures above the melting temperature of the casting material—the casting moulds 11 are surrounded concentrically by a heating chamber 14 which is closed at the upper end except for a pouring opening 15 by means of a cover 16. On its inside, the heating chamber 14 carries a group of radiant heaters 17 with electrical contacts 18 and at its bottom end has a ring-shaped radiation baffle 19. Concentric to this, a disc-shaped radiation baffle 20 is placed onto the heat sink 9 in such a way that a broad annular gap 21 is formed between the two radiation baffles 19 and 20 through which the casting moulds 11 may be moved at short distances from one another. As the heat sink 9 is lowered into the pit G, the thermal baffle 20 lies on the upper side 1a of the transport carriage 1 and is carried along upwards again when the heat sink is raised (FIGS. 1 and 2). During the solidification process the pouring opening 15 is covered to the top by a radiation protection means 14*a*.

The entire arrangement is surrounded by a vacuum chamber with sluice valves for the passage of the transport carriage 1, but these are not shown here. The heating chamber 14 is housed inside the vacuum chamber so that it may be raised, i.e. synchronously with the heat sink 9 and the radiation baffle 20 (arrows 22 and 23 in FIG. 2).

The entire plant is preferably a vacuum oven for precision casting for the production of components in virtually their end forms. The process of directional solidification and single-crystal solidification is used for highly stressed parts.

FIG. 1 shows a segment of the process in which the casting moulds 11 are pre-heated and ready for pouring off into the pouring basin 13.

FIG. 3 shows the conditions directly prior to the end of the solidification process, i.e. the heating chamber 14 with the radiation baffle 19 and the heat sink 9 with the radiation baffle 20 are raised practically over the entire height of the casting moulds 11, and these can transfer their thermal energy in the direction of the horizontal arrows both to the outside and inwards to the heat sink 9.

FIG. 2 shows very clearly the great extent to which the disc-shaped thermal baffle 20 prevents heat from radiating into the space below this thermal baffle. In particular, the radiation effect of the radiant heaters 17 in this case is also interrupted through the casting channels 12 and through the spaces between the casting moulds 11 to these casting moulds 11.

It goes without saying that the movement may also occur in kinematic reversal, i.e. the casting moulds 11 are then lowered with the ring-shaped cooling plate 5 in relation to the fixed heating chamber and a fixed heat sink at a speed which in this case is also directly connected with the rate of shift of the interphase.

FIG. 3 shows the star-shaped path of the casting moulds 12 from the pouring basin 13 to the individual casting moulds 11.

FIG. 4 shows the mould cavities 24 for casting turbine blades. These are surrounded by the thin-walled ceramic casting moulds 11. FIG. 4 also shows that the thermal radiation from the casting moulds can occur both inwards to the heat sink 9 (arrows 11*a*) and outwards (to the cooled wall parts of the vacuum chamber, arrows 11*b*).

Figure 5:
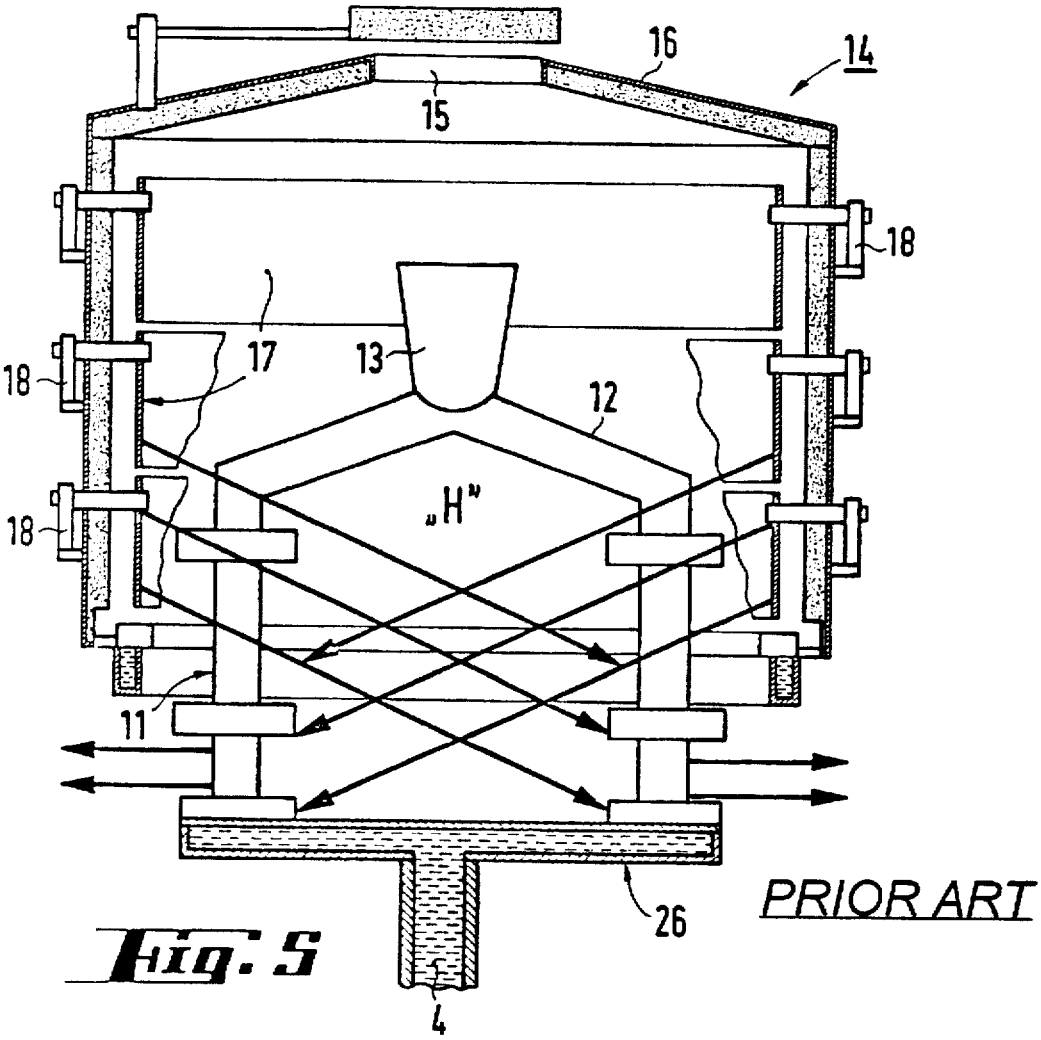
PRIOR ART Fig. 5
FIG. 5 shows a vertical section through a prior art device.
Figure 6:
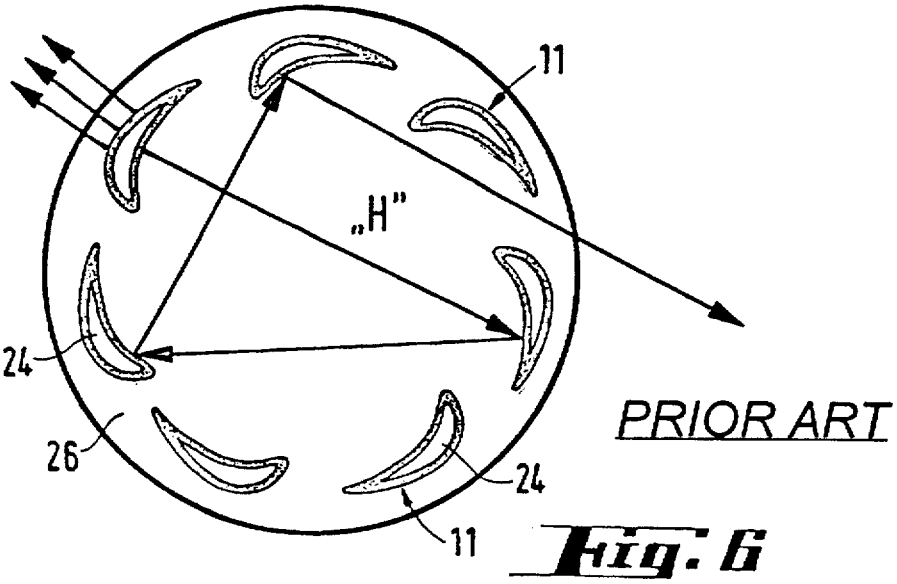
PRIOR ART Fig. 6
FIG. 6 shows a horizontal section through the subject of FIG. 5.

FIGS. 5 and 6 show the conditions in the prior art with a circular disc-shaped cooling plate 26 without a special central heat sink: heat is radiated from the radiant heaters 17 between the casting channels 12 and the casting moulds 11 through the cavity H and unhindered onto its inside surfaces (FIG. 5), and this thermal radiation is also partially reflected multiple times (FIG. 6). However, the thermal efficiency of the entire plant is impaired as a result of this because the radiation from the heating chamber downwards in only partially prevented.

The terms and expressions which have been employed are used as terms of description and not of limitation, and there is no intention in the use of such terms and expressions of excluding any equivalents of the features shown and described or portions thereof; it being recognized that various modifications are possible within the scope of the invention.

We claim:

1. A process for casting and directionally solidifying a plurality of castings in pre-heated casting molds, said process comprising:

placing the casting molds on a cooling plate around a central cavity in a heating chamber; and causing continuous relative movement of the casting molds with respect to a heat sink so that said heat sink extends into the central cavity and causes directional solidification by the continuous relative movement of the heat sink with respect to the casting mold.

2. The process of claim 1 and further comprising continuously removing the castings from the heating chamber by a relative vertical movement with respect to the heating chamber in accordance with solidification temperature so that the castings are cooled by heat radiation to below the solidus temperature.

3. The process of claim 1 wherein the heating chamber and the heat sink are moved synchronously relative to the cooling plate and the casting molds.

4. The process of claim 3 wherein the heating chamber and the heat sink are raised in relation to the cooling plate.

5. The process of claim 1 wherein a ring-shaped radiation baffle and a disc-shaped radiation baffle arranged at least essentially concentrically therein are arranged at an exit end of the heating chamber and the casting molds arranged in a ring shape are moved continuously into an interactive region of the heat sink, wherein said heat sink receives heat from said casting molds adjacent thereto, through an annular gap formed between the ring-shaped and disc-shaped radiation baffles.

6. The process of claim 1 wherein a relative position between the heating chamber and the heat sink is maintained essentially constant during the solidification process.

7. An apparatus for the casting and directional solidification of a plurality of castings in casting molds, said apparatus comprising:

a heating chamber and a ring-shaped cooling plate for erecting the casting molds in the heating chamber around a central cavity;

means for continuously removing the casting molds from the heating chamber by a relative vertical movement with respect to the heating chamber in accordance with the solidification temperature and cooling the castings by heat radiation to below the solidus temperature; and a heat sink with an interactive region wherein said heat sink draws heat from a surrounding area, the casting molds being moved adjacent said interactive region during the directional solidification by continuous relative movement in relation to the heat sink extending into the central cavity.

8. The apparatus of claim 7 further comprising a ring-shaped radiation baffle and a disc-shaped radiation baffle arranged at least substantially concentrically at an exit end of the heating chamber.

9. The apparatus of claim 8 further comprising an annular gap formed between the ring-shaped and disc-shaped radiation baffles in the interactive region of the heat sink and through which the casting molds may be continuously moved.

10. The apparatus of claim 7 wherein there is a constant axial distance between the heating chamber and the heat sink during the solidification process.

11. The apparatus of claim 7 further comprising a transport carriage, which has an opening through which the heat sink is moveable from a position below the transport carriage to a position above the transport carriage.

12. The apparatus of claim 11 wherein the ring-shaped cooling plate is arranged with the casting molds on the transport carriage.

13. The apparatus of claim 7 wherein the heat sink is constructed as a cooling body, the axial length of which corresponds at least to the height dimensions of the casting molds.

14. The apparatus of claim 8 wherein the disc-shaped radiation baffle lies on the heat sink during the solidification process and may be placed onto the upper surface of the transport carriage when the heat sink is lowered.

* * * * *